US007013793B2

(12) United States Patent
Dang

(10) Patent No.: US 7,013,793 B2
(45) Date of Patent: Mar. 21, 2006

(54) DIAPHRAGM MOUNTING METHOD FOR A DIAPHRAGM PUMP

(75) Inventor: Thang Q. Dang, Huntington Beach, CA (US)

(73) Assignee: ITT Manufacturing Enterprises, Wilmington, DE (US)

( * ) Notice: Subject to any disclaimer, the term of this patent is extended or adjusted under 35 U.S.C. 154(b) by 92 days.

(21) Appl. No.: 10/806,076

(22) Filed: Mar. 22, 2004

(65) Prior Publication Data

US 2005/0207906 A1 Sep. 22, 2005

(51) Int. Cl.
*F01B 13/04* (2006.01)

(52) U.S. Cl. ..... 92/99; 417/413.1; 417/415; 417/437; 417/472; 92/103 R; 92/70; 92/71

(58) Field of Classification Search ..... 417/413.1, 417/415, 437, 472; 92/99, 70, 71
See application file for complete search history.

(56) References Cited

U.S. PATENT DOCUMENTS

| | | | | |
|---|---|---|---|---|
| 2,991,723 | A | 7/1961 | Zubaty | |
| 4,153,391 | A | 5/1979 | Hartley | |
| 4,486,151 | A | 12/1984 | Korhonen-Wesala | |
| 4,610,605 | A | 9/1986 | Hartley | |
| 4,687,423 | A | 8/1987 | Maget et al. | |
| 5,533,886 | A * | 7/1996 | Von Der Heyde et al. | 418/1 |
| 5,615,597 | A | 4/1997 | Schoenmeyr | |
| 5,626,464 | A | 5/1997 | Schoenmeyr et al. | |
| 5,743,169 | A * | 4/1998 | Yamada | 92/100 |
| 5,791,882 | A | 8/1998 | Stucker et al. | |
| 6,048,183 | A | 4/2000 | Meza | |
| 6,264,438 | B1 * | 7/2001 | Fukami | 417/412 |
| 6,655,257 | B1 * | 12/2003 | Meyer | 92/99 |
| 2003/0031571 | A1 | 2/2003 | Yumakawa | |

* cited by examiner

*Primary Examiner*—Charles G. Freay
*Assistant Examiner*—Ryan Gillan
(74) *Attorney, Agent, or Firm*—Ware, Fressola, Van Der Sluys & Adolphson LLP

(57) ABSTRACT

A diaphragm pump and method for making same, the pump having a diaphragm coupled to a wobble plate achieved using: a post (11) protruding from the wobble plate toward the diaphragm and at least partially surrounded by a collar (11*a*); and a pin (22) protruding from the diaphragm toward the wobble plate and having a recess (22*a*) for mating with the post (11) and also having an outer portion (22*b*) surrounding the recess (22*a*) and able to resiliently deform so as to squeeze through the collar (11*a*) when the pin (22) is pushed onto the post (11). The outer portion (22*b*) of the pin typically includes a locking feature (22*c*) for holding the pin (22) on the post (11). The pin (22) and the diaphragm are typically made from thermoplastic materials, with the pin (22) typically made from a harder material than the diaphragm.

16 Claims, 3 Drawing Sheets

DIAPHRAGM MOUNTING METHOD FOR A DIAPHRAGM PUMP

TECHNICAL FIELD

The present invention pertains to the field of pump equipment. More particularly, the present invention pertains to attaching a diaphragm of a diaphragm pump to a wobble plate of the diaphragm pump.

BACKGROUND ART

Diaphragms for diaphragm pumps are often made by a stamping or injection molding process. A diaphragm pump has a piston and a wobble plate, and screws are often used to keep the diaphragm sandwiched between the piston and the wobble plate. The mounting holes on the diaphragm for such screws often create leak paths when the screws lose their clamping force. When pumping liquid gets through these holes, it can reach behind the diaphragm and get into the bearing and motor, possible causing the pump to fail. The average life span of such diaphragm pumps ranges from approximately 500 to 1000 hours, and the root causes of failure of such pumps is often problems associated with fluid leaking past the diaphragm.

What is needed is a way of mounting a diaphragm to a wobble plate in a diaphragm pump so as to make less it likely that the fluid being pumped will ever leak past the diaphragm.

DISCLOSURE OF THE INVENTION

Accordingly, in a first aspect of the invention, a diaphragm pump is provided having a diaphragm coupled to a wobble plate, the diaphragm and the wobble plate each having a front surface disposed so as to face the other, the diaphragm pump characterized in that the coupling comprises: a post protruding from the front surface of the wobble plate and at least partially surrounded by a collar; and a pin protruding from the front surface of the diaphragm, the pin having a recess for mating with the post, and having an outer portion surrounding the recess and able to resiliently deform so as to squeeze through the collar when the pin is pushed onto the post.

In a second aspect of the invention, a method is provided for use in making a diaphragm pump having a diaphragm coupled to a wobble plate, the diaphragm and the wobble plate each having a front surface disposed so as to face the other, the method characterized by: providing a post protruding from the front surface of the wobble plate and at least partially surrounded by a collar; and providing a pin protruding from the front surface of the diaphragm, the pin having a recess for mating with the post, and having an outer portion surrounding the recess and able to resiliently deform so as to squeeze through the collar when the pin is pushed onto the post.

In accord with the invention, the outer portion of the pin may include a locking feature for holding the pin on the post when the pin is pushed onto the post.

Also in accord with the invention, the pin and the diaphragm may be made from respective different thermoplastic materials, and the pin may be made from a harder material than the diaphragm. Further, the respective different thermoplastic materials may be from the same family of thermoplastic materials.

Also in accord with the invention, the pin may be formed so as to have one or more ring features along a bonding area between the pin and the diaphragm.

The invention provides several advantages: no screws are used to attach the diaphragm to the wobble plate of a diaphragm pump, and so no leak path is created, and no damage can be caused to the pump by such screws loosening and even falling out during operation. In fact, the inventor has observed that the average life of a diaphragm pump according to the invention is more than 1500 hours, compared to from 500 to 1000 hours for a pump using screws to attach the diaphragm to the wobble plate. Further, the time for the assembling is less, since a snap joint is used in place of screws.

BRIEF DESCRIPTION OF THE DRAWINGS

The above and other objects, features and advantages of the invention will become apparent from a consideration of the subsequent detailed description presented in connection with accompanying drawings, in which.

DETAILED DESCRIPTION OF THE INVENTION

The invention provides a way of attaching a wobble plate of a diaphragm pump to the diaphragm of the diaphragm pump, and also provides a diaphragm pump so constructed.

Figure 1B:
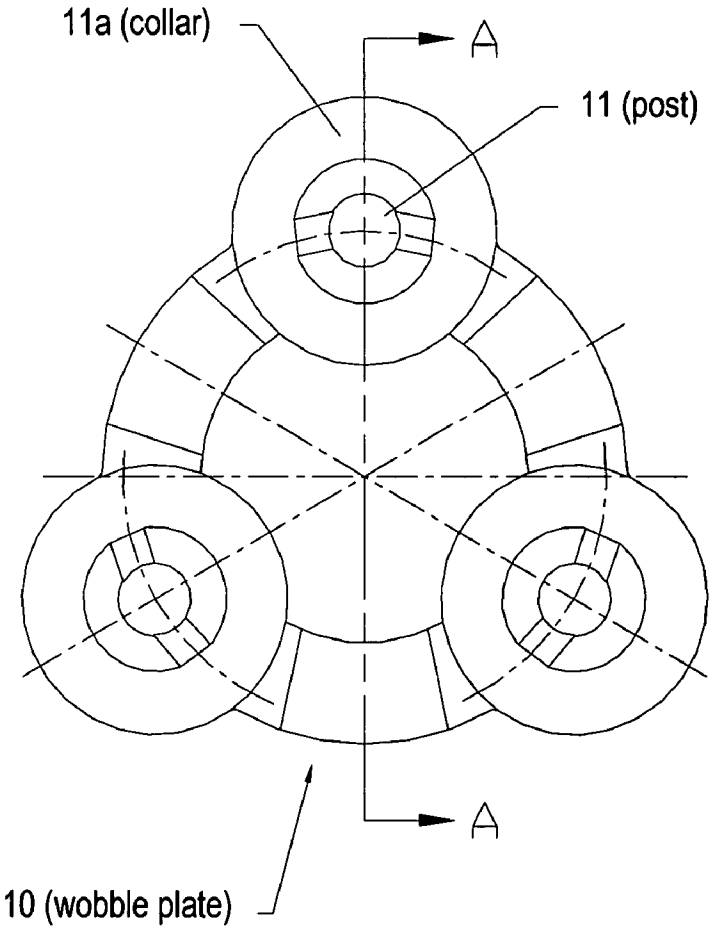
FIGS. 1A and 1B in combination show a wobble plate including a post and collar according to the invention.
Figure 1A:
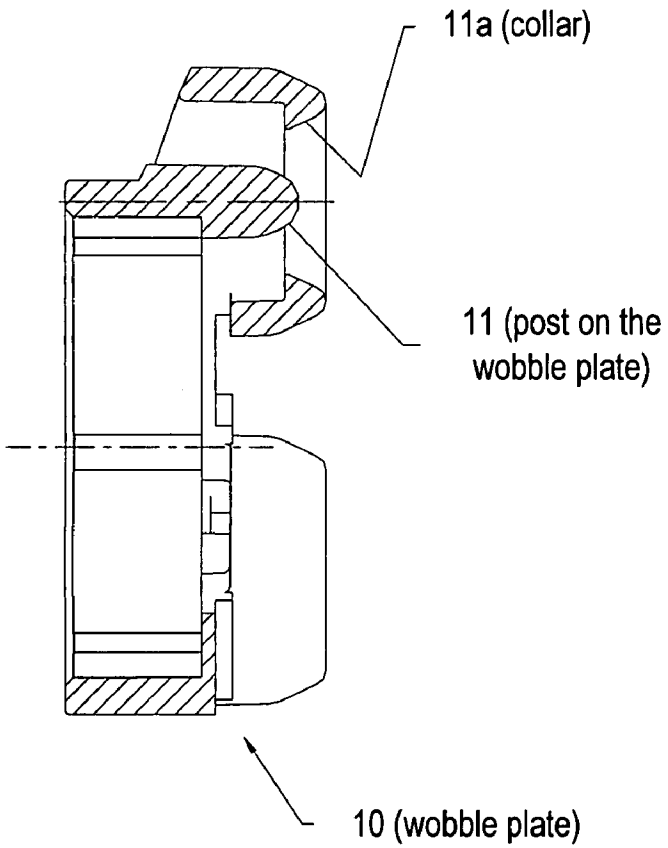

Referring now to FIGS. 1A and 1B, a wobble plate 10 of a diaphragm pump includes, according to the invention, one or more posts 11 protruding from a surface of the wobble plate each having a surrounding collar 11*a*. Each post 11 is disposed so as to protrude toward a facing surface of the diaphragm (not shown) of the diaphragm pump.

Figure 2:
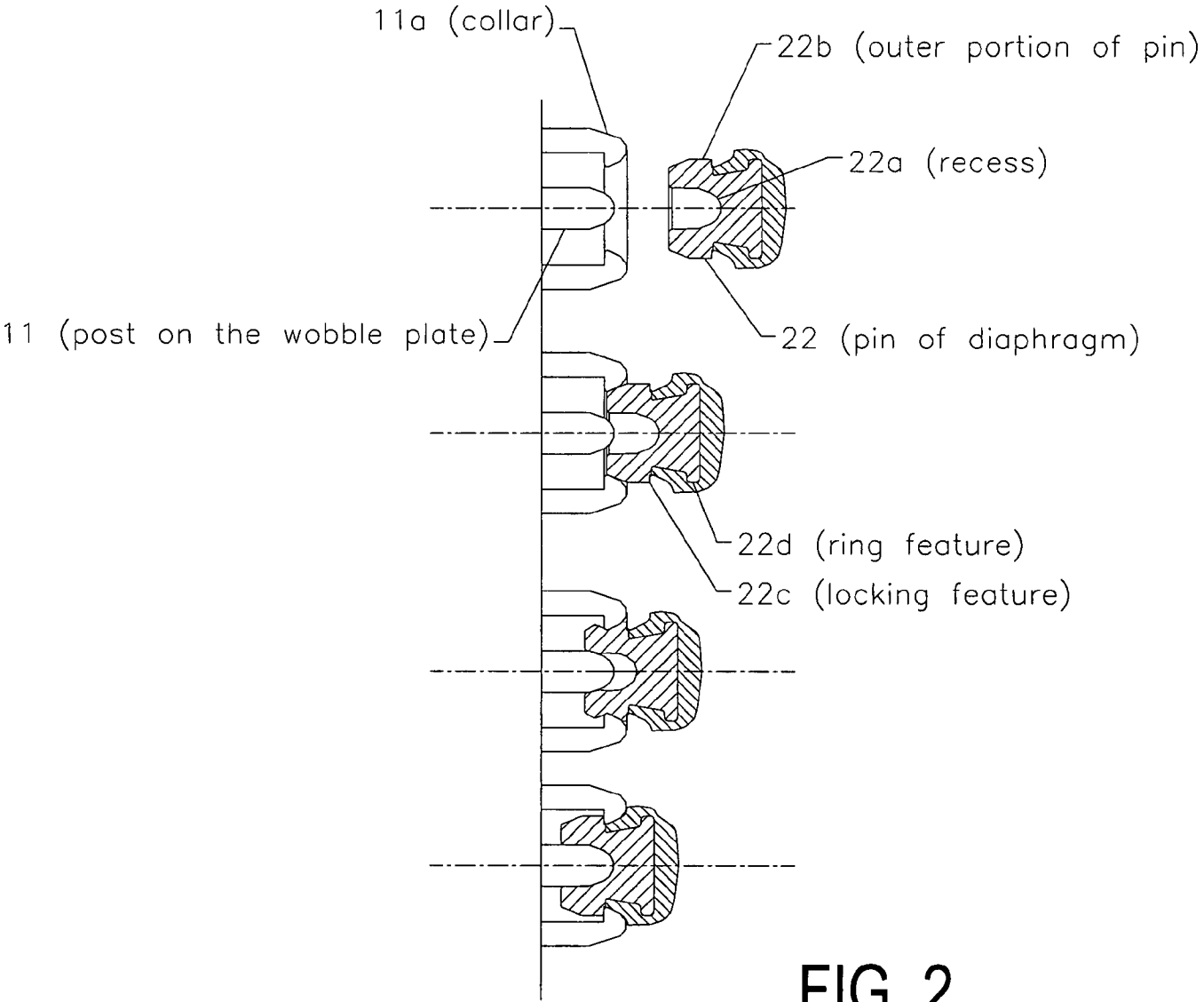
FIG. 2 is an illustration of a pin on a diaphragm according to the invention and so having a cavity for receiving the post shown in FIGS. 1A and 1B, and further, showing sequential stages of the pin being pushed onto the post.
Figure 3D:
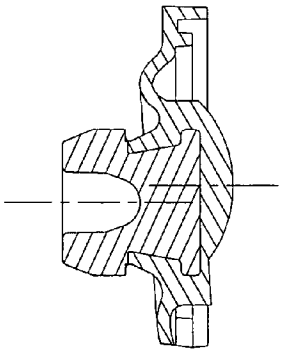
FIGS. 3A–E in combination show a diaphragm according to the invention, with FIG. 3A a side view cross section showing all components inside, FIG. 3B a back view showing the diaphragm with the pins, FIG. 3C another side view but not cross-sectioned to show inside components, FIG. 3D an enlarged view of a portion of FIG. 3C, and FIG. 3E a front view showing the diaphragm with pistons.
Figure 3C:
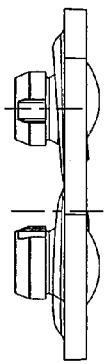
Figure 3A:
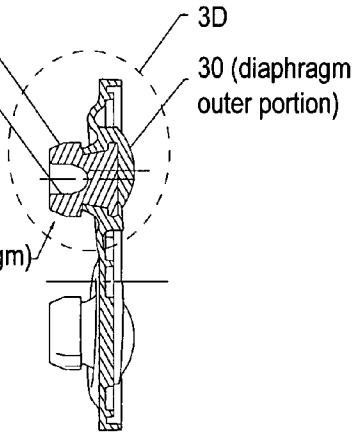
Figure 3B:
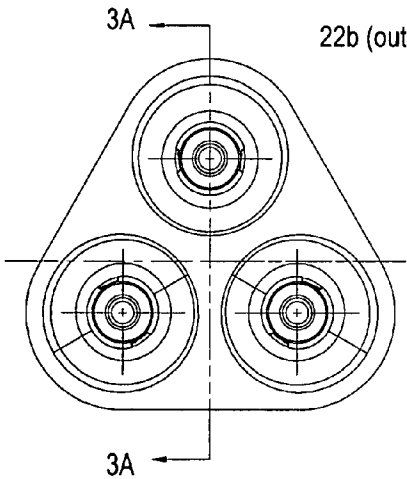
Figure 3E:
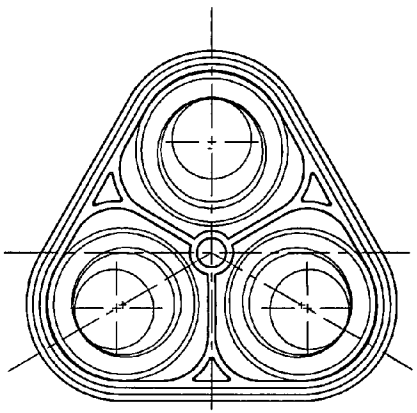

Referring now to FIG. 2 and FIGS. 3A–E, further according to the invention a (mounting) pin 22 for each post 11 is provided on the facing surface of the diaphragm having an outer portion 30. Each pin has a recess 22*a* for mating with a respective post 11, and also has an outer portion 22*b* surrounding the recess 22*a* and able to resiliently (ideally elastically) deform so as to squeeze through the collar 11*a* when the pin is pushed onto the post, as shown in FIG. 2 at different points in the attaching process. The outer portion 22*b* of each pin includes a locking feature 22*c* for holding the pin onto the respective post when the pin is pushed onto the post. The pin is advantageously formed with one or more ring features 22*d* so as to secure the bond between the pin and the diaphragm.

The pin 22 and the diaphragm are advantageously made from respective different thermoplastic materials, preferably from the same family of thermoplastic materials, with the pin being made from a harder material than the diaphragm so that the pin does not stretch but the diaphragm does deform and so acts as a better seal, keeping the pumped fluid from the chamber behind the diaphragm. If the respective materials for the pin and diaphragm come from the same family of thermoplastic materials, then they have a strong bond after molding.

As illustrated in FIG. 2, when the pin 22 is pressed onto the post 11 through the collar 11*a* of the post, the outer portion 22*b* of the pin first squeezes to a smaller size to get through the collar. The squeezing continues until the outer portion of the pin moves past the collar (which occurs before or at the same time as the post strikes the wall of the recess 22*a* of the pin). Once the outer portion is past the collar of the post, its resilience tends to force it to return to its original shape and size. Independent of any action caused by the resilience of the outer portion, though, the post entering the recess of the mounting pin causes the outer portion of the pin to return to its original shape and size because of the post pushing on the inside of the outer portion. Once the outer portion of the pin moves past the collar of the post, the mounting pin locks/snap fits onto the collar of the wobble plate.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A diaphragm pump, having a diaphragm coupled to a wobble plate, the diaphragm and the wobble plate each having a front surface disposed so as to face the other, the diaphragm pump characterized in that the coupling comprises:

a post (11) protruding from the front surface of the wobble plate and at least partially surrounded by a collar (11*a*); and a pin (22) protruding from the front surface of the diaphragm, the pin (22) having a recess (22*a*) for mating with the post (11), and having an outer portion (22*b*) surrounding the recess (22*a*) and able to resiliently deform so as to squeeze through the collar (11*a*) when the pin (22) is pushed onto the post (11).

2. A diaphragm pump as in claim 1, wherein the outer portion (22*b*) of the pin includes a locking feature (22*c*) for holding the pin (22) on the post (11) when the pin (22) is pushed onto the post (11).

3. A diaphragm pump as in claim 1, further characterized in that the pin (22) and the diaphragm are made from respective different thermoplastic materials, and the pin (22) is made from a harder material than the diaphragm.

4. A diaphragm pump as in claim 3, wherein the respective different thermoplastic materials are from the same family of thermoplastic materials.

5. A diaphragm pump as in claim 1, further characterized in that the pin (22) is formed so as to have one or more ring features (22*d*) along a bonding area between the pin (22) and the diaphragm.

6. A diaphragm pump as in claim 1, wherein the collar (11*a*) extends outward from the wobble plate toward a distal end of the post (11) substantially the same distance as the post (11).

7. A diaphragm as in claim 6, further wherein the collar (11*a*) includes a region protruding radially inward toward the distal end of the post (11), and the outer portion (22*b*) of the pin (22) includes a thickened region (22*c*) serving as a locking feature, wherein after the pin (22) is pushed onto the post (11) the thickened region (22*c*) of the outer portion (22*b*) of the pin (22) occupies a region between the post (11) and the collar (11*a*) and is prevented from being removed by interference of the thickened region (22*c*) with the region of the collar (11*a*) protruding radially inward toward the distal end of the post (11).

8. A method for use in making a diaphragm pump having a diaphragm coupled to a wobble plate, the diaphragm and the wobble plate each having a front surface disposed so as to face the other, the method characterized by:

providing a post (11) protruding from the front surface of the wobble plate and at least partially surrounded by a collar (11*a*); and providing a pin (22) protruding from the front surface of the diaphragm, the pin (22) having a recess (22*a*) for mating with the post (11), and having an outer portion (22*b*) surrounding the recess (22*a*) and able to resiliently deform so as to squeeze through the collar (11*a*) when the pin (22) is pushed onto the post (11).

9. A method as in claim 8, wherein the outer portion (22*b*) of the pin includes a locking feature (22*c*) for holding the pin (22) on the post (11) when the pin (22) is pushed onto the post (11).

10. A method pump as in claim 8, further characterized in that the pin (22) and the diaphragm are made from respective different thermoplastic materials, and the pin (22) is made from a harder material than the diaphragm.

11. A method pump as in claim 10, wherein the respective different thermoplastic materials are from the same family of thermoplastic materials.

12. A method pump as in claim 8, further characterized in that the pin (22) is formed so as to have one or more ring features (22*d*) along a bonding area between the pin (22) and the diaphragm.

13. A method as in claim 8, wherein the collar (11*a*) extends outward from the wobble plate toward a distal end of the post (11) substantially the same distance as the post (11).

14. A method as in claim 13, further wherein the collar (11*a*) and includes a region protruding radially inward toward the distal end of the post (11), and the outer portion (22*b*) of the pin (22) includes a thickened region (22*c*) serving as a locking feature, wherein after the pin (22) is pushed onto the post (11) the thickened region (22*c*) of the outer portion (22*b*) of the pin (22) occupies a region between the post (11) and the collar (11*a*) and is prevented from being removed by interference of the thickened region (22*c*) with the region of the collar (11*a*) protruding radially inward toward the distal end of the post (11).

15. A diaphragm pump, having a diaphragm as a first component coupled to a wobble plate as a second component, the diaphragm and the wobble plate each having a front surface disposed so as to face the other, the diaphragm pump characterized in that the coupling comprises:

a post (11) protruding from the front surface of one of the components and at least partially surrounded by a collar (11*a*) having a surface for serving as a stop; and a pin (22) protruding from the front surface of the other of the components, the pin (22) having a recess (22*a*) for mating with the post (11), and having an outer portion (22*b*) substantially surrounding the recess (22*a*) including a wider section and a narrower section connected by a surface serving as a stop for engagement with the stop surface of the post.

16. A method for use in making a diaphragm pump having a diaphragm as one component coupled to a wobble plate as another component, the diaphragm and the wobble plate each having a front surface disposed so as to face the other, the method characterized by:

providing a post (11) protruding from the front surface of one of the components and at least partially surrounded by a collar (11*a*); and providing a pin (22) protruding from the front surface of the other of the components, the pin (22) having a recess (22*a*) for mating with the post (11), and having an outer portion (22*b*) substantially surrounding the recess (22*a*) including a wider section and a narrower section connected by a surface serving as a stop for engagement with the stop surface of the post.

* * * * *